US007681289B2

(12) United States Patent
Liu

(10) Patent No.: US 7,681,289 B2
(45) Date of Patent: Mar. 23, 2010

(54) FASTENER FOR FASTENING TOGETHER TWO LACE SEGMENTS

(76) Inventor: Kun-Chung Liu, No. 5, Alley 9, Lane 212, San-Feng Rd., Hou-Li Hsiang (TW)

( * ) Notice: Subject to any disclaimer, the term of this patent is extended or adjusted under 35 U.S.C. 154(b) by 421 days.

(21) Appl. No.: 11/734,018

(22) Filed: Apr. 11, 2007

(65) Prior Publication Data

US 2008/0250617 A1 Oct. 16, 2008

(51) Int. Cl.
*A43C 7/00* (2006.01)
*A43C 7/06* (2006.01)

(52) U.S. Cl. ..... 24/712.5; 24/712.1

(58) Field of Classification Search ..... 24/712.5, 24/712.1, 712.2, 712.4, 712.7, 712.8, 712.9, 24/115 A, 136 K; 36/50.1
See application file for complete search history.

(56) References Cited

U.S. PATENT DOCUMENTS 6,779,281 B1 * 8/2004 Liu ..... 36/50.1
6,796,009 B1 * 9/2004 Liu ..... 24/712.6
6,817,070 B1 * 11/2004 Liu ..... 24/712.5
6,839,944 B1 * 1/2005 Liu ..... 24/712.1
6,938,307 B2 * 9/2005 Liu ..... 24/712.5
7,036,193 B1 * 5/2006 Liu ..... 24/712
7,124,482 B2 * 10/2006 Kim ..... 24/712.1

* cited by examiner

*Primary Examiner*—Victor Batson
*Assistant Examiner*—Rowland D Do
(74) *Attorney, Agent, or Firm*—Merchant & Gould P.C.

(57) ABSTRACT

A fastener for fastening together two lace segments includes a base, a pull unit, and two clamp units. The base has an intermediate portion, and two openings disposed on two opposite sides of the intermediate portion. Each of the openings is adapted to permit one of the lace segments to extend therethrough. The pull unit includes a middle portion fixed to the base, and two opposite pull members extending outwardly from the middle portion. The clamp units are respectively connected to the pull members and are disposed above the openings. Each of the clamp units defines a through hole adapted to permit one of the lace segments to extend therethrough. The clamp units are movable toward the openings to effect clamping and are movable away from the openings when the pull members are pulled away from the base.

4 Claims, 6 Drawing Sheets

FASTENER FOR FASTENING TOGETHER TWO LACE SEGMENTS

BACKGROUND OF THE INVENTION

1. Field of the Invention

The invention relates to a fastener, more particularly to a fastener for fastening together two lace segments.

2. Description of the Related Art

Referring to FIG. 1, U.S. Pat. No. 6,796,009 B1 discloses a shoelace fastener including a main body 1, a pull unit 2 secured on the main body 1, and a covering band 3 surrounding the main body 1 and the pull unit 2. The main body 1 includes a pivot axle 4, and first and second fastener bodies 5, 6 disposed side by side and pivotally interconnected through the pivot axle 4. Each of the first and second fastener bodies 5, 6 is formed with a through hole 501, 601 having a respective hole axis (Z). Each of the first and second fastener bodies 5, 6 is further formed with a respective slot 502, 602 extending in a respective longitudinal direction (X) transverse to the hole axis (Z) and in spatial communication with the through hole 501, 601 in a transverse direction (Y) transverse to the hole axis (Z) and the longitudinal direction (X), and is provided with a respective clamping pin 503, 603 extending in the transverse direction (Y) and movable along the longitudinal direction (X). The pull unit 2 is attached to the first and second fastener bodies 5, 6 through strings 504, 604.

When a manual pulling force is applied on the first and second fastener bodies 5, 6 through the pull unit 2, the first and second fastener bodies 5, 6 are pivotally moved toward each other so as to enable movement of the clamping pins 503, 603 toward the pivot axle 4, thereby releasing a shoelace.

Although the shoelace can be fastened and released by the aforesaid shoelace fastener, it has the following disadvantages:

1. The main body 1 includes the pivot axle 4, and the first and second fastener bodies 5, 6, and the strings 504, 604 are required for attaching the first and second fastener bodies 5, 6 to the pull unit 2. Therefore, the shoelace fastener of the prior art is composed of a relatively large number of components.

2. The first and second fastener bodies 5, 6 are pivotally interconnected by penetrating the pivot axle 4 through the first and second fastener bodies 5, 6 and then riveting the pivot axle 4. Furthermore, the pull unit 2 is attached to the first and second fastener bodies 5, 6 through the strings 504, 604. Therefore, the assembly procedure for the shoelace fastener of the prior art is relatively complicated.

3. The main body 1 has a relatively large size. Hence, the pull unit 2 is unable to conceal the main body 1 satisfactorily.

Referring to FIG. 2, U.S. Pat. No. 6,938,307 B2 discloses a shoelace fastener including a positioning seat 8, a pull lace 7 disposed over the positioning seat 8, a pair of flexible string sections 9 connected to the positioning seat 8 and the pull lace 7 and each defining an opening 90, a tying lace 9" extending around the positioning seat 8 and the pull lace 7 and fixed thereto by riveting, and a pair of clamp members 9', each of which is attached slidably to and extends across a corresponding one of the flexible string sections 9 to divide the opening 90 into a first aperture 903' and a second aperture 904'.

In use, each of opposite lace segments of a shoelace is extended through the first aperture 903' of the opening 90, over the corresponding one of the clamp members 9', and into the second aperture 904' of the opening 90. When a shoe body is tightened, each of the clamp members 9' is forced by a corresponding one of the lace segments to move from the first aperture 903' toward the second aperture 904' such that each of the lace segments is clamped in a clamping position.

Although the shoelace can be fastened and released by the aforesaid shoelace fastener, each of the flexible string sections 9 is required to be provided with one of the clamp members 9' by penetrating the flexible string sections 9 through the clamp members 9'. Furthermore, the pull lace 7 should be connected to the flexible string sections 9 for pulling the flexible string sections 9. Therefore, the assembly procedure for the shoelace fastener of the prior art is relatively complicated.

SUMMARY OF THE INVENTION

Therefore, the object of the present invention is to provide a fastener which has a simplified structure and which is easy to assemble.

Accordingly, a fastener for fastening together two lace segments of this invention includes a base, a pull unit, and two clamp units. The base has an intermediate portion, and two openings disposed on two opposite sides of the intermediate portion. Each of the openings is adapted to permit one of the lace segments to extend therethrough. The pull unit includes a middle portion fixed to the base, and two opposite pull members extending outwardly from the middle portion. The clamp units are respectively connected to the pull members and are disposed above the openings. Each of the clamp units defines a through hole adapted to permit one of the lace segments to extend therethrough. The clamp units are movable toward the openings to effect clamping and are movable away from the openings when the pull members are pulled away from the base.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
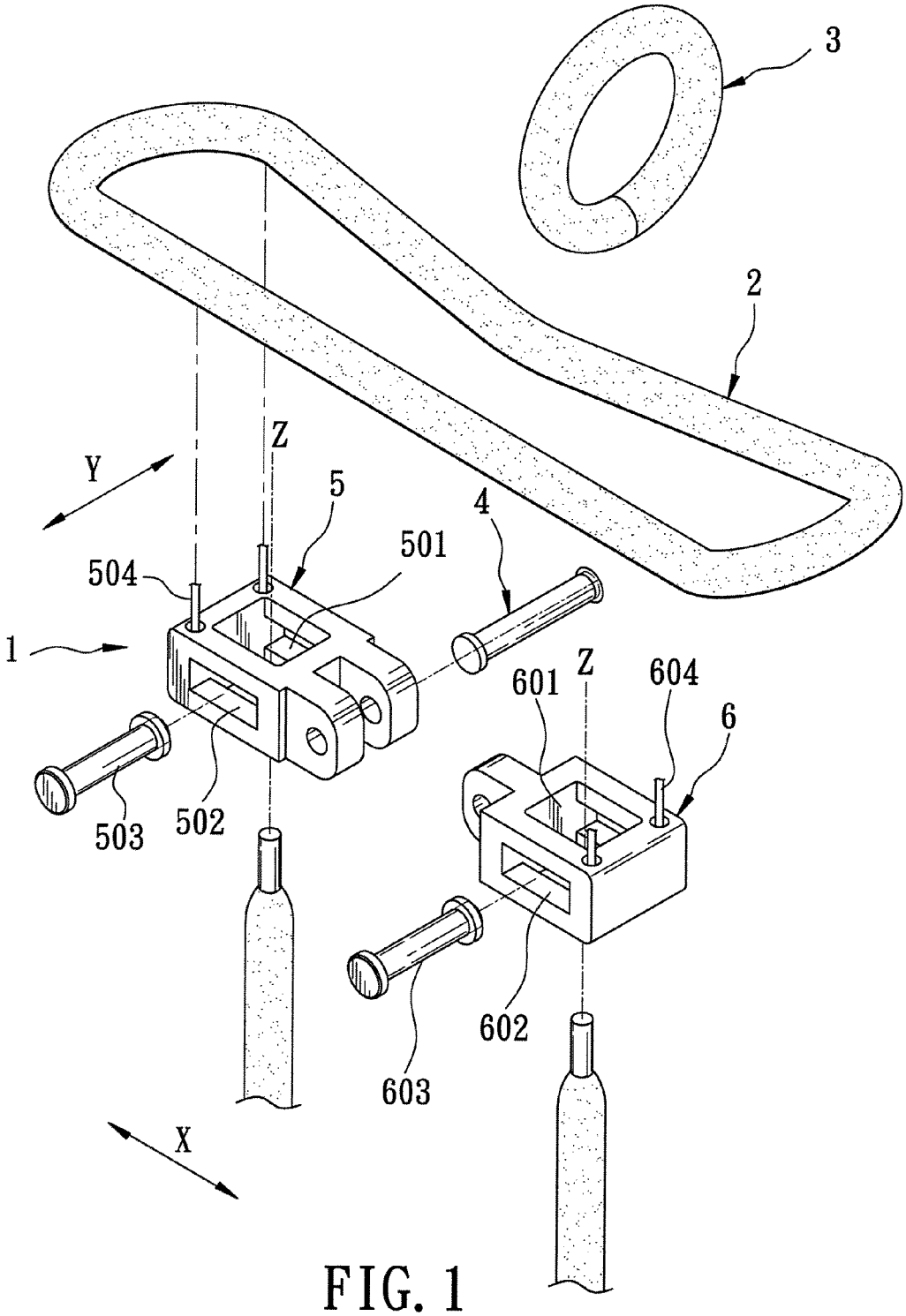
FIG. 1 PRIOR ART
FIG. 1 is an exploded perspective view of a conventional shoelace fastener.
Figure 2:
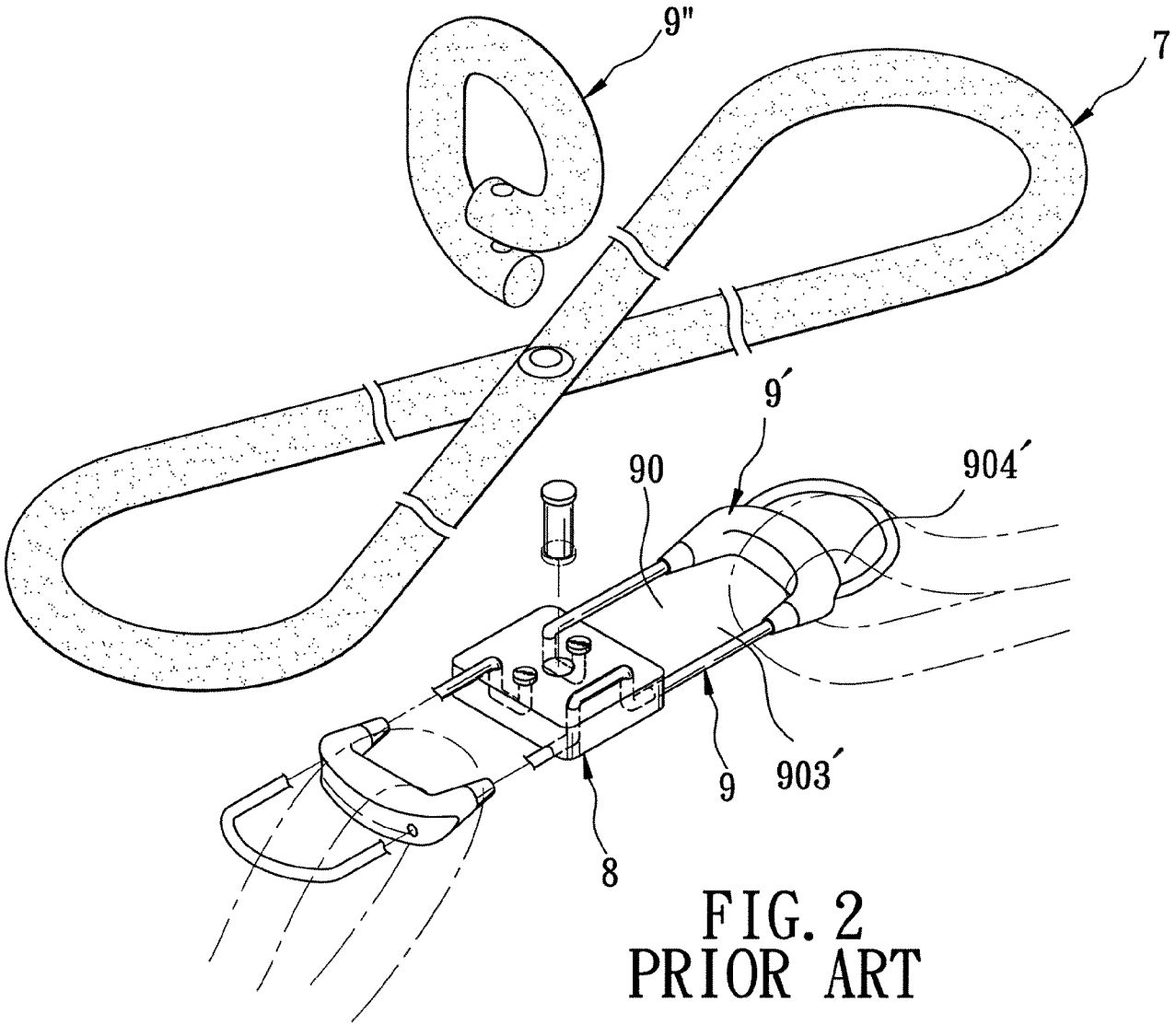
FIG. 2 PRIOR ART
FIG. 2 is an exploded perspective view of another conventional shoelace fastener.
Figure 3:
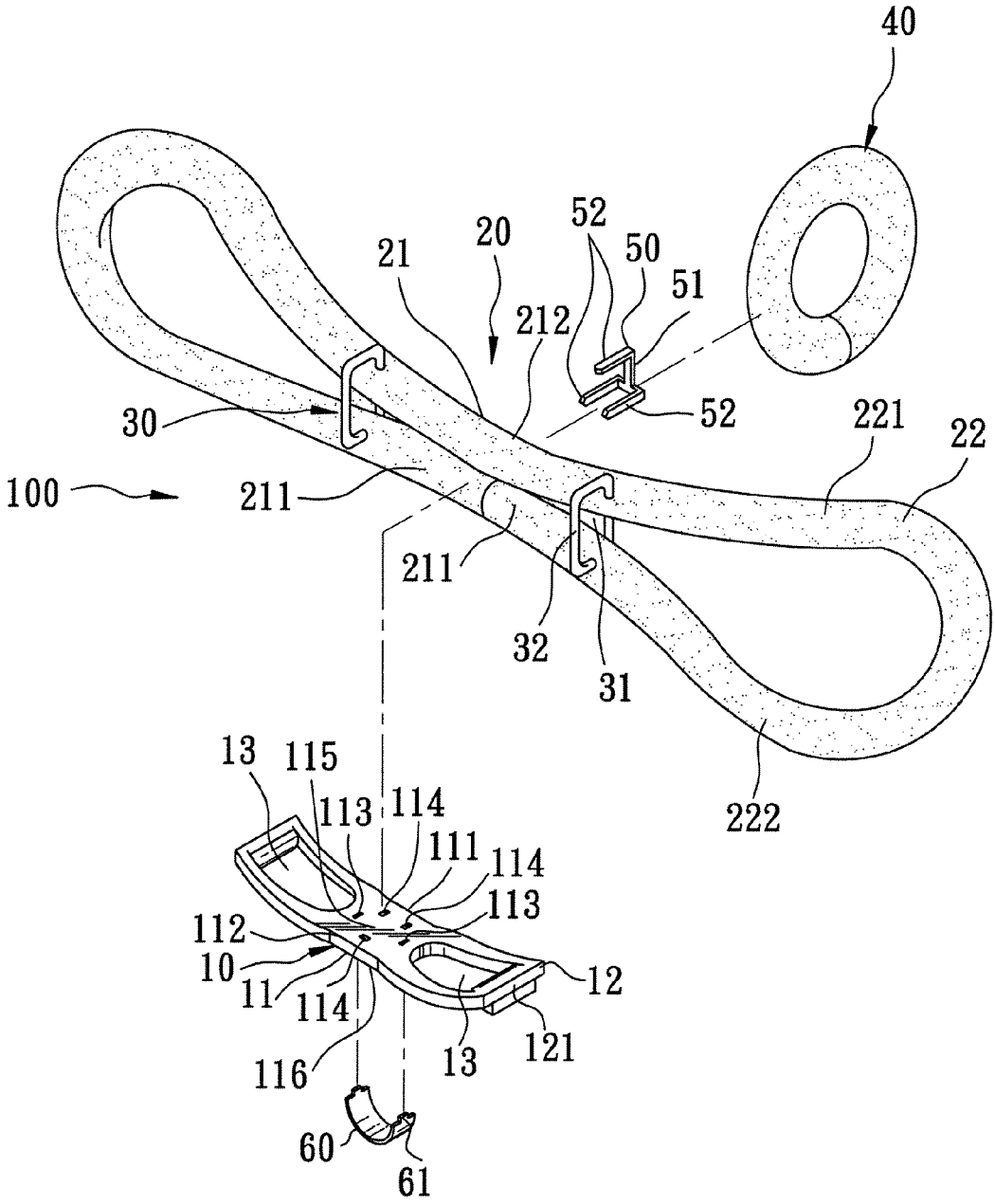
FIG. 3 is an exploded perspective view of a preferred embodiment of a fastener for fastening together two lace segments according to this invention.
Figure 4:
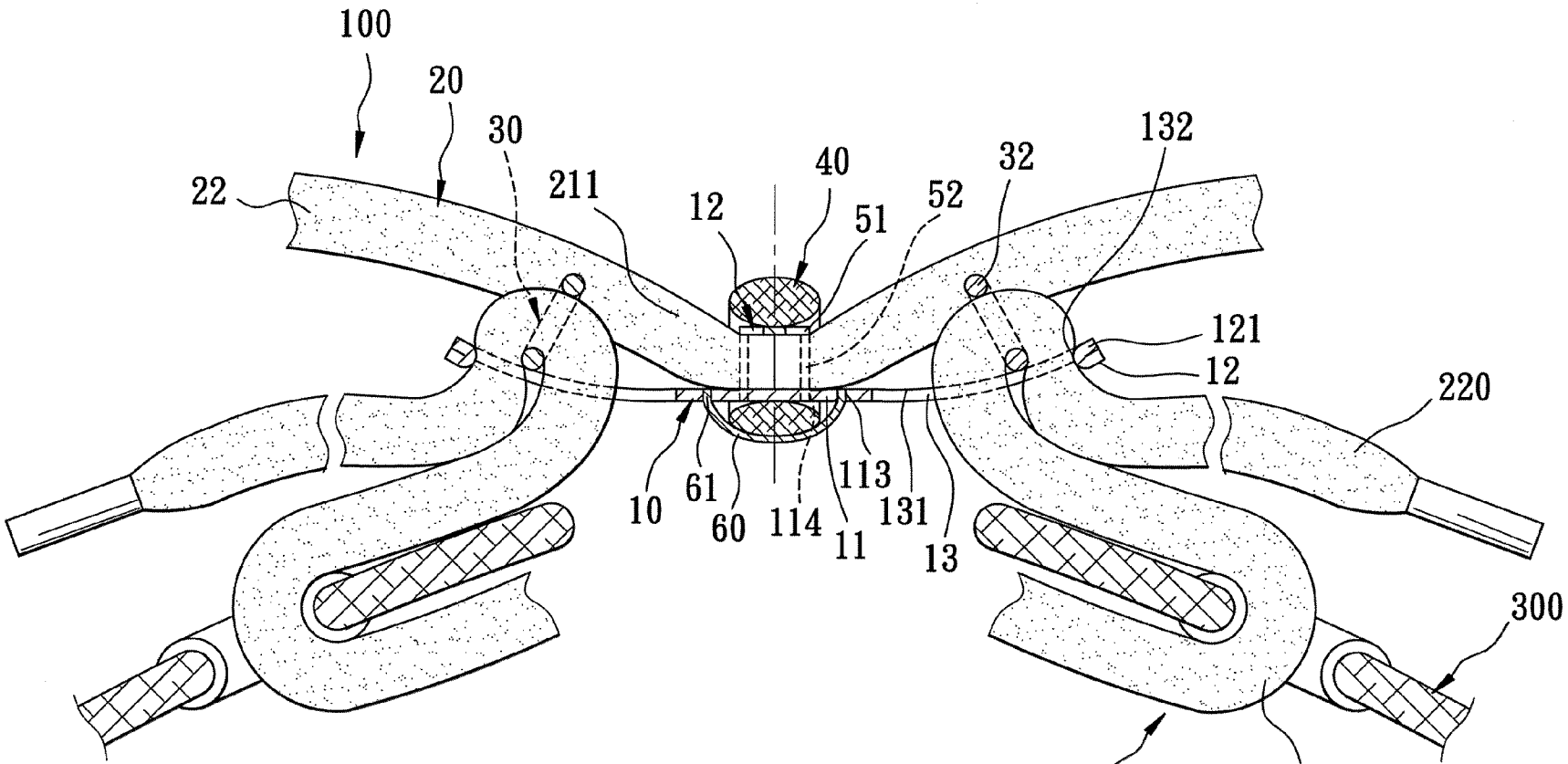
FIG. 4 is a fragmentary sectional view of the preferred embodiment to illustrate a tightening operation of the preferred embodiment.
Figure 5:
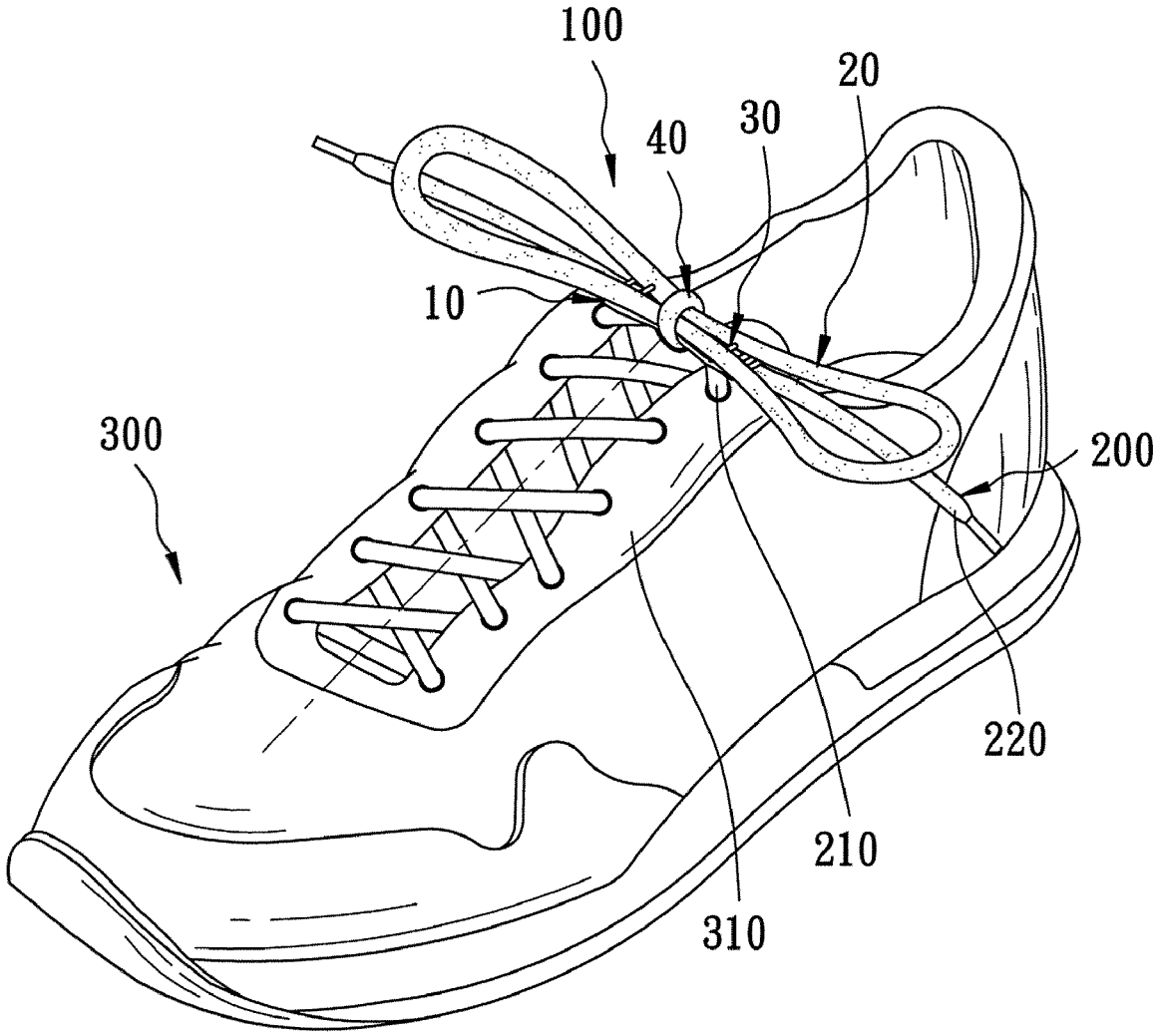
FIG. 5 is a perspective view showing a shoe that incorporates the preferred embodiment of this invention.

Referring to FIGS. 3, 4, and 5, the preferred embodiment of a fastener 100 according to this invention is shown to be adapted for use with a shoe 300 which includes a pair of eyelet tabs 310 and a shoelace 200 having an anchoring segment 210 strung on the eyelet tabs 310, and a pair of distal lace segments 220, each of which is connected to the anchoring segment 210 at one end. The fastener 100 includes a base 10, a pull unit 20, two clamp units 30, an anchoring member 50, a ring 40, and a curved retaining member 60. It should be noted herein that, except for FIG. 5, the fastener 100 is not drawn to scale in the accompanying drawings and is actually illustrated in a magnified form for the sake of clarity. Although the fastener 100 of this invention as exemplified in the preferred embodiment is used together with a shoe, it can also be used in other applications, such as clothes, backpacks, hats, and the like.

The base 10 is formed by punching a metal plate, and has an intermediate portion 11, and two openings 13 disposed on two opposite sides of the intermediate portion 11. Each of the openings 13 is adapted to permit one of the distal lace segments 220 to extend therethrough. The intermediate portion 11 includes a first side face 111, a second side face 112 opposite to the first side face 111, a top face 115 extending between the first and second side faces 111, 112, a bottom face 116 opposite to the top face 115, two connecting holes 113 each extending through the top and bottom faces 115, 116, and a plurality of anchoring holes 114 extending through the top and bottom faces 115, 116.

The base 10 further has two looped edges 12 respectively defining the openings 13. Each of the looped edges 12 has a clamping edge portion 121 disposed away from the intermediate portion 11. The clamping edge portion 121 cooperates with a respective one of the clamp units 30 to effect clamping. In the preferred embodiment, the base 10 is a one-piece plate. That is, the looped edges 12 are integral with the intermediate portion 11.

The pull unit 20 includes a middle portion 21 fixed to the base 10, and two opposite pull members 22 extending outwardly from the middle portion 21. Each of the pull members 22 has a first string segment 221 that extends outward from the middle portion 21 and a second string segment 222 that returns toward the middle portion 21. The pull unit 20 is formed from a string having two string end parts 211, and a middle string part 212. The string end parts 211 are end-to-end facing each other and are substantially parallel to the middle string part 212. The middle portion 21 of the pull unit 20 is defined by the string end parts 211 and the middle string part 212.

The anchoring member 50 is made of metal, and has a press part 51 formed as a T-shape and pressing the middle portion 21 of the pull unit 20 against the base 10, and a plurality of anchoring legs 52 extending from the press part 51, penetrating the middle portion 21 of the pull unit 20, and fixed to the base 10. One of the anchoring legs 52 penetrates through the middle string part 212, and the other two of the anchoring legs 52 penetrate the string end parts 211, respectively. The anchoring legs 52 are inserted respectively into the anchoring holes 114, and are welded to the base 10 in the anchoring holes 114.

The clamp units 30 are respectively connected to the pull members 22 and are disposed above the openings 13. Each of the clamp units 30 defines a through hole 31 adapted to permit one of the lace segments 220 to extend therethrough. The clamp units 30 are movable toward the openings 13 to effect clamping and are movable away from the openings 13 when the pull members 22 are pulled away from the base 10. Each of the clamp units 30 has a ring 32 fixed to the first and second string segments 221, 222 and defining a respective one of the through holes 31. The ring 32 is movable toward the clamping edge portion 121 of a respective one of the looped edges 12 to effect clamping. The ring 32 cooperates with a respective one of the looped edges 12 to divide the corresponding opening 13 into a first aperture 131 proximate to the base 10, and a second aperture 132 proximate to the clamping edge portion 121.

The ring 40 surrounds the base 10 and the middle portion 21 of the pull unit 20.

The curved retaining member 60 is fixed to the base 10 opposite to the anchoring member 50 so as to embrace a portion of the ring 40. The curved retaining member 60 includes two opposite end portions 61 received in the connecting holes 113 of the base 10 and welded to the base 10.

In use, each of the distal lace segments 220 is extended through the first aperture 131 of a corresponding one of the openings 13, passes through the through hole 31 of a corresponding one of the clamp units 30, into the second aperture 132 of the corresponding one of the openings 13, and out of the clamping edge portion 121 of a corresponding one of the looped edges 12. At the same time, the pull unit 20, the ring 40, and the distal lace segments 220 cooperate to form a double-bow configuration. After a foot (not shown) is slipped into the shoe 300, the distal lace segments 220 can be pulled apart from each other to tighten the shoe 300. When the shoe 300 is tightened, the eyelet tabs 310 are forced apart by the foot in the shoe 300, thereby applying tension on the shoelace 200. At the same time, each of the clamp units 30 is forced by a corresponding one of the distal lace segments 220 to move toward the clamping edge portion 121 of the corresponding one of the looped edges 12 such that each of the distal lace segments 220 is clamped in a clamping position between a corresponding one of the clamp units 30 and the clamping edge portion 121 of the corresponding one of the looped edges 12 for maintaining a tightened state of the shoe 300 (best shown in FIGS. 4 and 5).

Figure 6:
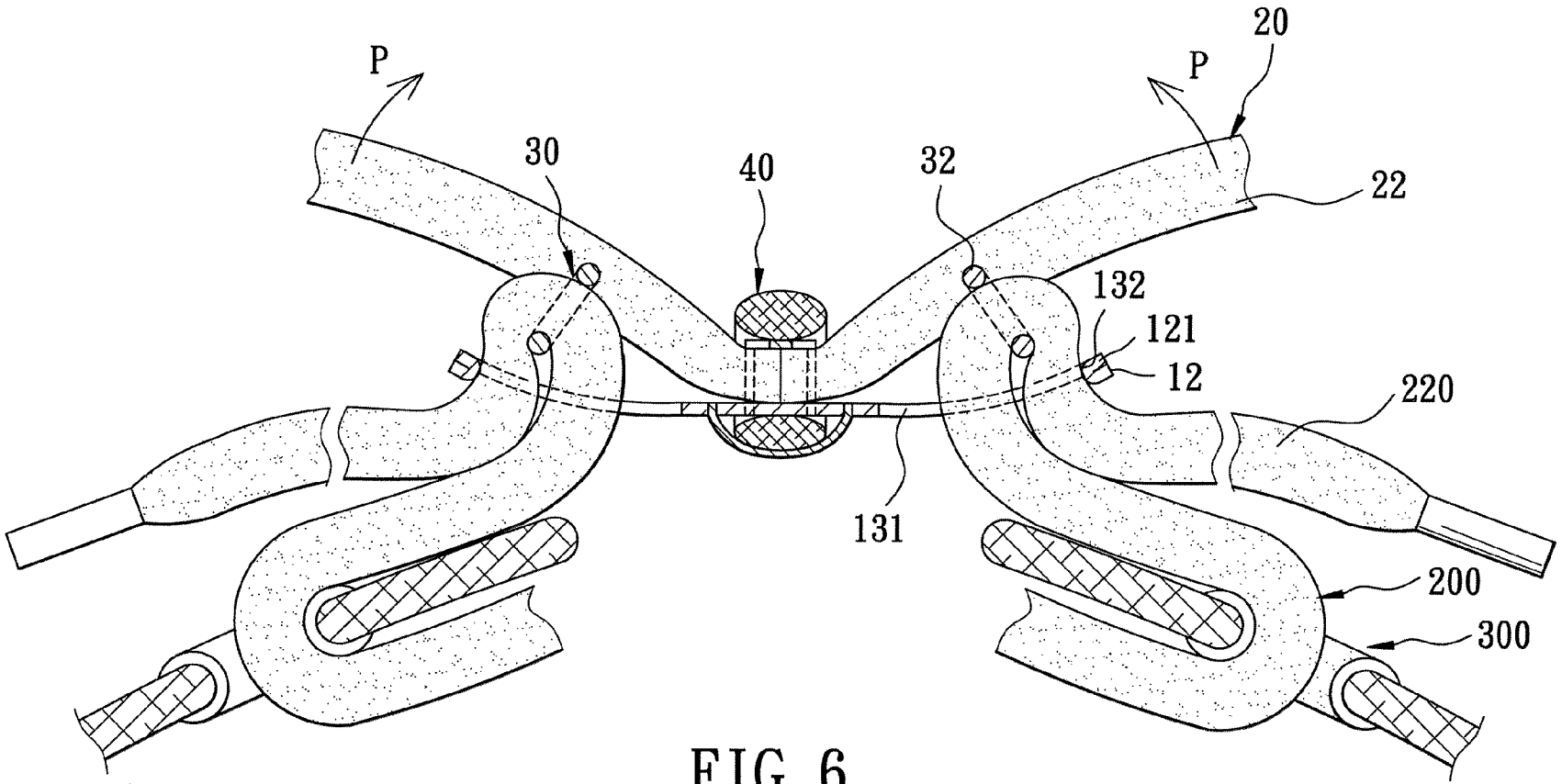
FIG. 6 is a fragmentary sectional view of the preferred embodiment to illustrate a loosening operation of the preferred embodiment.

Referring to FIG. 6, to loosen the shoe 300, a manual pulling force is applied on the pull members 22, as indicated by arrows (P). This results in movement of the clamp units 30 away from the clamping edge portion 121 of the corresponding one of the looped edges 12, thereby releasing the distal lace segments 220 from being clamped by the corresponding one of the clamp units 30 against the clamping edge portion 121 of the corresponding one of the looped edges 12 so as to permit sliding movement of the distal lace segments 220 for loosening the shoe 300 accordingly.

In view of the aforesaid, it is not necessary to connect the ring 32 of each of the clamp units 30 to a corresponding one of the looped edges 12 of the base 10. Therefore, the fastener 100 of this invention has a simplified structure, and is relatively easy to assemble. Furthermore, the sizes of the base 10 and the rings 32 can be designed to be smaller as compared to the prior art so as not to result in an adverse affect on the appearance of the shoe 300.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A fastener for fastening together two lace segments, comprising:

a base having an intermediate portion, and two openings disposed on two opposite sides of said intermediate portion, each of said openings being adapted to permit one of the lace segments to extend therethrough;

a pull unit including a middle portion fixed to said base, and two opposite pull members extending outwardly from said middle portion; and two clamp units respectively connected to said pull members and disposed above said openings, each of said clamp units defining a through hole adapted to permit one of the lace segments to extend therethrough, said clamp units being movable toward said openings to effect clamping and being movable away from said openings when said pull members are pulled away from said base, wherein said base further has two looped edges respectively defining said openings, each of said looped edges having a clamping edge portion disposed away from said intermediate portion, said clamping edge portion cooperating with a respective one of said clamp units to effect clamping, and wherein each of said pull members has a first string segment that extends outward from said middle portion and a second string segment that returns toward said middle portion, and each of said clamp units has a ring fixed to said first and second string segments and defining a respective one of said through holes, said ring being movable toward said clamping edge portion of a respective one of said looped edges to effect clamping.

2. The fastener as claimed in claim 1 wherein said base is a one-piece plate.

3. A fastener for fastening together two lace segments, comprising:

a base having an intermediate portion, and two openings disposed on two opposite sides of said intermediate portion, each of said openings being adapted to permit one of the lace segments to extend therethrough;

a pull unit including a middle portion fixed to said base, and two opposite pull members extending outwardly from said middle portion;

two clamp units respectively connected to said pull members and disposed above said openings, each of said clamp units defining a through hole adapted to permit one of the lace segments to extend therethrough, said clamp units being movable toward said openings to effect clamping and being movable away from said openings when said pull members are pulled away from said base;

an anchoring member made of metal, and having a press part pressing said middle portion of said pull unit against said base, and a plurality of anchoring legs extending from said press part, penetrating said middle portion of said pull unit, and fixed to said base;

a ring surrounding said base and said middle portion of said pull unit; and a curved retaining member fixed to said base opposite to said anchoring member so as to embrace a portion of said ring, said curved retaining member including two opposite end portions fixed to said base.

4. The fastener as claimed in claim 3, wherein said base is a one-piece plate.

* * * * *